US006029886A

United States Patent [19]

Sheffer

[11] Patent Number: 6,029,886

[45] Date of Patent: Feb. 29, 2000

[54] STACKABLE CONTAINER

[75] Inventor: Phil B. Sheffer, Thomasville, Pa.

[73] Assignee: Pack "N "Stack, Inc., Philadelphia, Pa.

[21] Appl. No.: 09/129,375

[22] Filed: Aug. 5, 1998

[51] Int. Cl.[7] ..... B65D 5/24

[52] U.S. Cl. ..... 229/168; 229/167; 229/178; 229/186

[58] Field of Search ..... 229/160, 167, 229/168, 178, 186, 187, 188, 242

[56] References Cited

U.S. PATENT DOCUMENTS

| | | | |
|---|---|---|---|
| 2,388,243 | 11/1945 | Arneson | 229/167 |
| 2,529,147 | 11/1950 | Frankenstein | 229/167 |
| 3,067,924 | 12/1962 | Baker et al. | 229/160 |
| 4,034,908 | 7/1977 | Forbes, Jr. et al. | 229/160 |
| 4,056,223 | 11/1977 | Williams | 229/160 |
| 4,341,339 | 7/1982 | Zore | 229/167 |
| 5,277,360 | 1/1994 | DeMott | 229/122 |
| 5,413,276 | 5/1995 | Sheffer | 229/120.11 |

FOREIGN PATENT DOCUMENTS

| | | | |
|---|---|---|---|
| 1192574 | 10/1959 | France | 229/167 |
| 1422615 | 11/1965 | France | 229/167 |
| 115106 | 7/1968 | Norway | 229/167 |
| 1514346 | 6/1978 | United Kingdom | 229/167 |

*Primary Examiner*—Gary E. Elkins
*Attorney, Agent, or Firm*—Duane Morris & Heckscher LLP

[57] ABSTRACT

A collapsible container for packing, shipping and displaying articles is formed from an integral piece of corrugated craft, paperboard or similar foldable material. The container includes a plurality of panels which are connected to form a bottom, front, back and exterior sidewalls, and preferably also a top. A bellows fold connects each of the exterior sidewalls with at least one of the front and back walls. Each exterior sidewall is provided with a respective interior sidewall which together support a horizontal ledge. The horizontal ledges are useful for stacking multiple cartons in vertical alignment and can support containers that are somewhat out of registry. Locking tabs extend from the bellows panels of the container to limit lateral deflection of the sides and deformation of the container.

10 Claims, 3 Drawing Sheets

STACKABLE CONTAINER

BACKGROUND OF THE INVENTION

1. Field of the Invention

The invention relates to cartons, and more particularly, to a packing/shipping/display container formed from an integral flat piece of sheet material.

2. Prior Art

Cartons or containers formed from folded corrugated paperboard or similar flat sheet stock material are often stacked on one another during shipping and storage of products. In high volume retail stores, product is not only stored in stacked cartons, but frequently is presented to consumers in that form, that is, with the stacked cartons disposed on pallets. Stacking is obviously efficient as to the use of space, and pallets enable a number of cartons to be handled as a unit. The uppermost remaining carton on a pallet is accessible to consumers for obtaining the product. When empty, the carton is removed and the next lower carton becomes accessible.

Each pallet generally contains multiple, vertically stacked layers of boxes, with each layer consisting of multiple boxes arranged horizontally adjacent to one another. Sometimes boxes are oriented such that upper boxes overlap two or more boxes in a next lower layer. However, this is not always possible or advisable, for example when the boxes have open tops to permit access to the product in the boxes. In such cases the boxes may be stacked in registry with one directly over another, effectively creating multiple adjacent "towers" of stacked boxes that laterally abut one another but are not structurally engaged. These towers can be unstable.

Containers in stacks are subjected to various forces, not limited to static vertical compression due to the weight of containers over them in a stack. Static and dynamic vertical and horizontal forces (as well as vertical compressive force) are generated by handling, whether such handling involves transport of a stack on a pallet or manual handling of one or more containers in a stack, etc. Tension and/or compression applied in various directions to the container walls can be sufficient to wholly or partly collapse a container, to deflect, bend or laterally fold the walls of a container, or to cause the bottom of a container to drop into the open top of a next lower container, with possible damage to the contents as well as misalignment of the stack.

Inasmuch as the paperboard material, for example corrugated craft, is structured to withstand forces in the plane of the material, the result of any deformation is a reduction in structural integrity, and may include crushing or other damage to the container contents. A deformed container may no longer provide a stable horizontal support for containers stacked over it. If the containers of an overlying stack are displaced or handled inappropriately, the stack may then tip laterally. A mishandled "tower" of containers may fall, and even if there is no injury to persons, the contents of the containers may spill or be damaged.

Pallets and similar arrangements of multiple stacked containers are popular means for presenting products to consumers in so-called "warehouse" stores, wholesale clubs, and other facilities which have versatile open floor space and need to move a substantial quantity of product. In such situations, pallet storage is preferable because substantially less work, attention and expense is required than in stocking shelves. The pallet or other supporting arrangement of multiple stacked containers from the shipper is simply moved onto the floor of the warehouse or other sales establishment without rearrangement or modification to the stacks of containers. External strapping is removed, and the top-most containers can be opened so that the items can be seen and selected by customers for purchase. As containers are emptied, they are generally flattened for recycling, and the next underlying containers are opened until the pallet of containers eventually is emptied, removed and replaced.

Use of pallets of shipping/display containers for storage and display of product at the customer level heightens problems with total or partial collapse of the containers or stacks of containers. For example, in addition to handling by retail/warehouse personnel typically associated with pallets of containers, multiple potential customers have access to and perhaps manipulate stacked containers. Crushed or damaged containers are immediately visible to potential customers, reducing the appeal of the product and potentially damaging the reputation of the warehouse retailer or other seller. If mishandling occurs and a stack of containers falls, the resulting spilled containers and products at a minimum may disrupt traffic flow.

Apart from instability due to partial collapse of the walls of one or more containers in a stack, instability leading to spills and possible collapse of a stack may be caused by containers being shifted too far in the horizontal direction relative to underlying containers. Customer access and traffic in retail/warehouse stores increases the likelihood that containers may be moved horizontally to an extent that they are no longer supported in a stable manner on underlying containers.

Likewise, it often is necessary for stock clerks at the warehouse retailer to rearrange containers on a pallet as containers are emptied, for example to consolidate product from a number of nearly empty open cartons into one, to restack or reposition the cartons for neatness, etc. It is advantageous if such rearrangement can be accomplished easily and quickly, especially because stock clerk staffing at warehouse retailers is preferably minimal. Containers stacked on a pallet, however, may be difficult to maneuver easily or quickly, may be stacked in close proximity to each other and may be bulky and cumbersome when filled with merchandise. If containers are stacked on open containers, which is sometimes desirable, the stack may have inadequate support.

There is a need for a container with improved strength characteristics to withstand collapsing, deformation and lateral deflection of the load-bearing vertical container walls which may result when excessive forces are applied to such containers.

There is further a need for a container that is optimally adapted for pallet-type marketing, namely retail sale of products displayed in bulk in the containers in which they are shipped in bulk.

There is a further need for a container which is easy to manipulate and easy to open to display and access the contents thereof.

There is also a need for the container to have sufficient lateral rigidity to avoid collapse.

Advantageously, these needs should be met in a carton that is foldably erected from a one piece blank that is compactly arranged such that the carton blanks can be die cut from stock with minimal waste, folded and glued in a preferably-automatic apparatus such that they are stored or shipped while knocked down flat, and later erected for use.

SUMMARY OF THE INVENTION

It is an object of the invention to provide a container with improved vertical strength and lateral rigidity, and which otherwise overcomes the drawbacks and disadvantages of the prior art.

These and other objects are provided according to the invention in a container having a plurality of interconnected panels which form a bottom, top, front wall, back wall, and exterior side walls. At least one bellows fold connects each of the front and back walls with a respective one of the exterior side walls. The container includes a pair of horizontal top ledges which are each supported at an outer edge of the container by a respective one of the exterior side walls. The opposite or inner edge of each top ledge is supported by a respective one of a pair of interior side walls, folded downwardly into the container.

According to an inventive aspect, strengthening flaps are provided and hingedly connected to opposite side edges of each interior side wall. The strengthening flaps are folded over and secured to the interior side walls of the container. Locking tabs connected to each bellows fold abut the underside of the horizontal top ledges when the container is erected to substantially improve the container's lateral rigidity.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
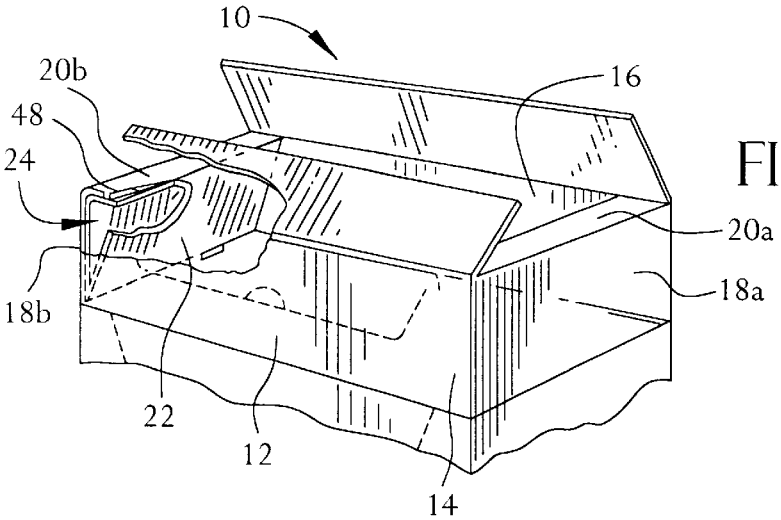
FIG. 1 is a perspective view of an erected container according to the invention, partly cut away, with top flaps shown partially folded open.

FIG. 1 shows a stackable container according to the invention, as erected, open and stacked on a similar container. The container 10 in the open state defines a rectilinear box shape having a front wall 14, a back wall 16, and exterior sidewalls 18, each hingedly connected to a bottom 12 along a fold line. The opposite exterior sidewalls 18 each have a corresponding interior sidewall 22. Both interior sidewalls 22 are connected to, and together support, a top ledge 20 in a substantially horizontal orientation. A bellows fold 24 connects each of the front and back walls 14 and 16 with each of the exterior sidewalls 18.

The combination of interior and exterior sidewalls 18 and 22 strengthens the container 10 by improving its resistance to deformation from vertical compressive forces and lateral deflection. The ledges 20 are supported by the interior and exterior sidewalls 18 and 22, which resist compression in their respective planes. The ledges and the inner walls also extend inwardly between the front and rear walls and stiffen the container structure. Thus, the structure of sidewalls 18, 22 provides a pair of stable platforms on which upper containers can be stacked while permitting some horizontal misalignment due to the width of the ledges. As discussed in detail below, the inventive container includes additional structural features, namely locking tabs 48, which further lock ledges 20 from deflecting laterally.

Figure 2:
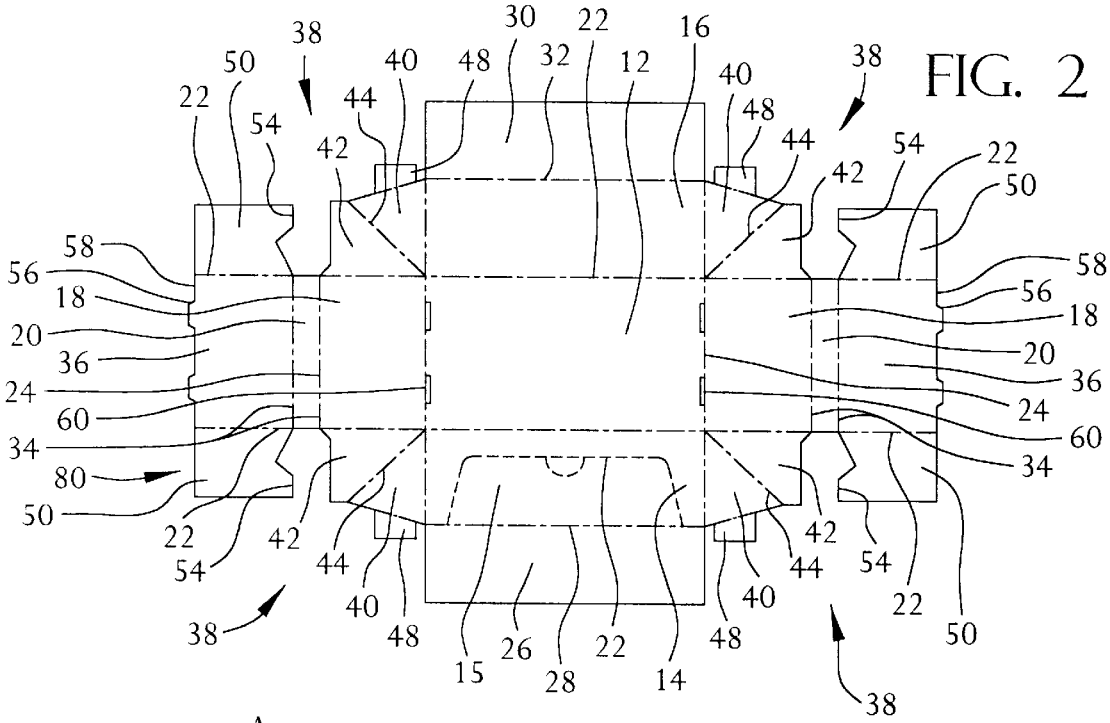
FIG. 2 is a top plan view of a flat blank formed from an integral sheet of material to be folded and glued to form the container shown in FIG. 1.

FIG. 2, shows the panels of container 10 laid flat in the form of a blank 80, as it appears after being cut from an integral piece of corrugated craft, paperboard or other foldable sheet material. Container 10 includes four main panels 14, 16, and 18 (two of the last), foldably connected to panel 12 along respective transverse and vertical fold lines 22 and 24, for example score lines. The score lines facilitate the folding of the panels relative to one another.

Comparing FIGS. 1 and 2, panel 12 defines the bottom of container 10; panels 18 function as opposite exterior sidewalls of the container 10; and, panels 14 and 16 respectively function as the front and back walls of container 10.

Two of the four main panels 14, 16, 18 comprising blank 80 are also provided with top flap panels connected along transverse scorelines. The first panel 14 includes a first top flap panel 26 foldably connected along scoreline 28. The second panel 16 includes a second top flap panel 30 foldably connected along scoreline 32. Panels 26 and 30 together form the top flaps of the container 10, and can be folded outwardly to access the contents in the interior of the container. The flaps can be made removable, for example via perforations, and perforations can also be provided to remove a front panel window portion 15 or to permit portion 15 to be folded downwardly into the container to reinforce the lower part of the front wall 14 while providing unobstructed access to the contents of the container.

Each of the exterior sidewall panels 18 is foldably connected to its respective interior sidewall panel 36 along two spaced parallel scorelines 34, which define the inner and outer longitudinal edges of top ledge panels 20. As seen in FIG. 1, panels 36 function as interior sidewalls of container 10 when folded down over exterior side walls 18 along parallel scorelines 34, which together support horizontal top ledges 20. The interior sidewalls 36 are secured in their erected positions by first locking tabs 56 which protrude from the lower edges 58 of interior sidewall panels 36 and interlock with complementary locking slots 60 in bottom panel 12.

With continuing reference to FIG. 2, the first and second main panels 14 and 16 are each foldably connected to third and fourth main panels 18 along fold lines 22 and 24 by a bellows fold panel 38. Each bellows fold panel 38 is formed from a pair of triangularly shaped panels 40 and 42 which are foldably connected along scoreline 44. Each triangular panel 40 further includes a second locking tab 48 foldably connected to and extending therefrom. As shown in FIG. 1, when the container is erected, panels 40 and 42 are folded inwardly of the container along scoreline 44 to form a bellows fold 38.

Panels 50 are foldably connected to opposite side edges of each of the interior sidewall panels 36 along transverse scorelines 22. The panels 50 each include a cutout 52 on a top edge 54 thereof. The shape of the cutout 52 is complementary to the profile of the second locking tab portion 48. As shown in FIG. 1, when the container is erected, panels 50 function as strengthening flaps. The strengthening flaps 50 are folded over and adhesively secured to respective interior flaps 36, and second locking tabs 48 abut the underside of top ledges 20. When assembled, the second locking tabs 48 increase the rigidity of the container 10 by preventing relative shifting between the front and sidewall panels. In particular, second locking tabs 48 inhibit the ledges 20 from deflecting laterally outwardly, thereby improving the stiffness of the container and its resistance to lateral deflection and deformation.

Figure 3:
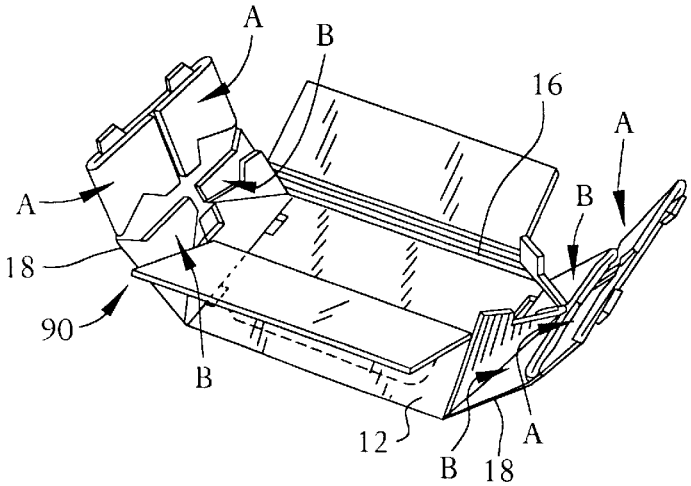
FIG. 3 is a perspective view of the blank of FIG. 2 after certain of the gluing and folding operations.

FIGS. 3–6 show container 10 in progressive stages of erection and assembly. In FIG. 3, the blank 80 has been folded along scorelines 22, and panels 42 are folded over and glued to exterior sidewall panels 18 in the direction shown by arrows B. Strengthening flap panels 50 are folded over and glued to respective interior sidewall panels 36 in the direction shown by arrows B. After such folding and gluing operations, blank 80 is in the form of a shipper's blank 90. The folded/glued blank is laid flat and can be stacked, stored and shipped in this knocked down flat condition prior to packing.

Figure 4:
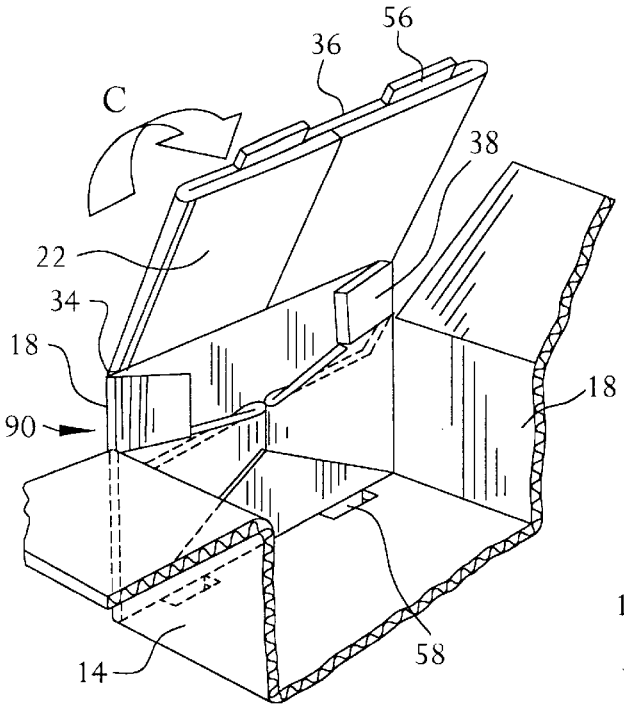
FIG. 4 is partial perspective view of the glued blank of FIG. 3, with the end wall folded up and the inner end wall panel being folded over to form the ledge.

As shown in FIG. 4, to erect the flattened container 10 from its glued blank 90, the two exterior side panels 18 are rotated inwardly around their fold connection with the bottom panel until panels 18 are vertically oriented. This rotation causes each of the bellows folds 38 to collapse such that opposed faces of panels 40 and 42 are brought into contact, whereby the four exterior wall panels are positioned to form oppositely parallel and adjacently perpendicular vertical walls of a rectilinear box, namely front wall 14, back wall 16 and opposite exterior sidewalls 18 of the container.

Interior sidewall panels 36 are then folded further inwardly on scorelines 34, down over their respective exterior walls 18. First locking tabs 56 engage automatically engage locking slots 60 as the inner panels 36 are rotated into their final position.

Figure 6:
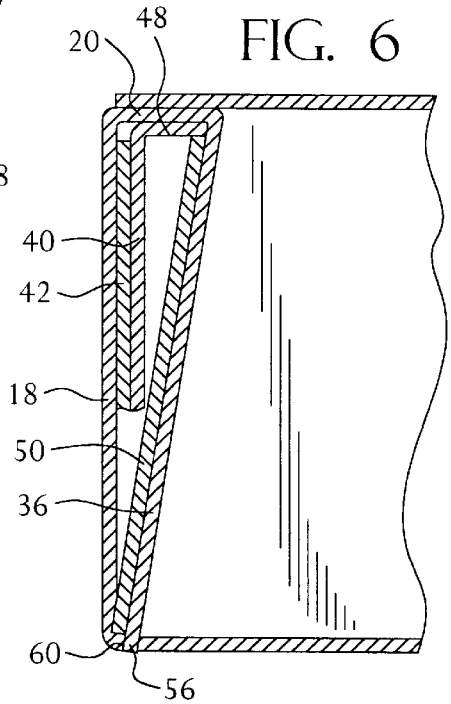
FIG. 6 is a side sectional view of the container of FIG. 1.
Figure 5:
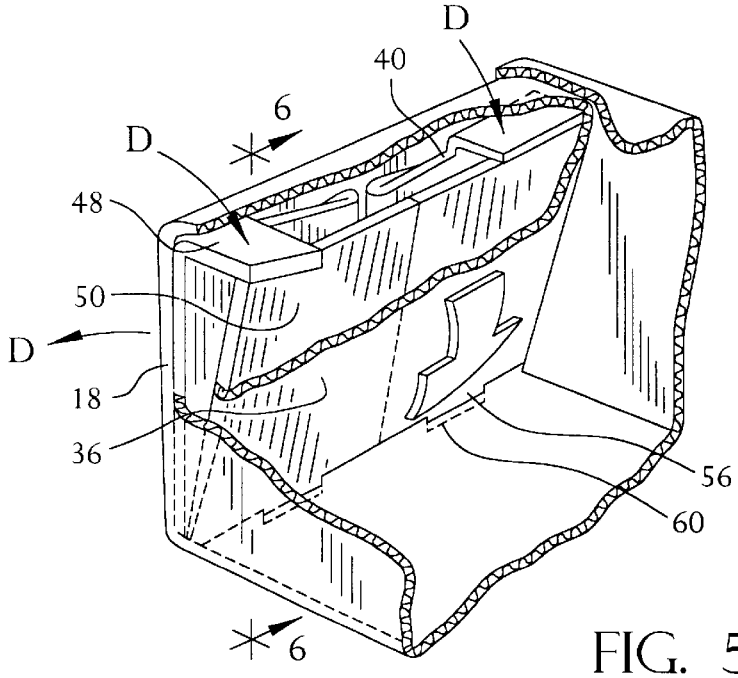
FIG. 5 is a partial perspective view of the container of FIG. 1, illustrating internal engaging structures between the inner and outer end wall panels.

As best illustrated with reference to FIGS. 5 and 6, the erected exterior and interior sidewalls 18 and 36 straddle respective bellows folds 38. The interior sidewall 18 and the exterior sidewall 36 together define an acute angle whose vertex is located at locking slots 58 in the bottom panel. The mechanical interlocking of the respective tabs and slots, together with the inward extension of the ledge and inner sidewall panel between the front and rear walls as well as the multiple layers of material at the bellows folds, form a rigid container having good vertical strength and substantial resistance to vertical and horizontal deformation.

Figure 7:
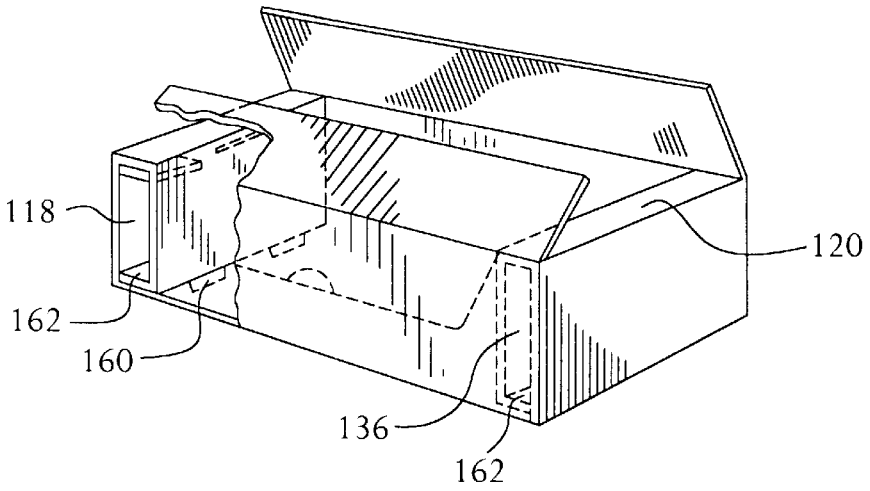
FIG. 7 is a perspective view partly in phantom and partly cutaway, illustrating another embodiment of an erected container according to the invention.
Figure 8:
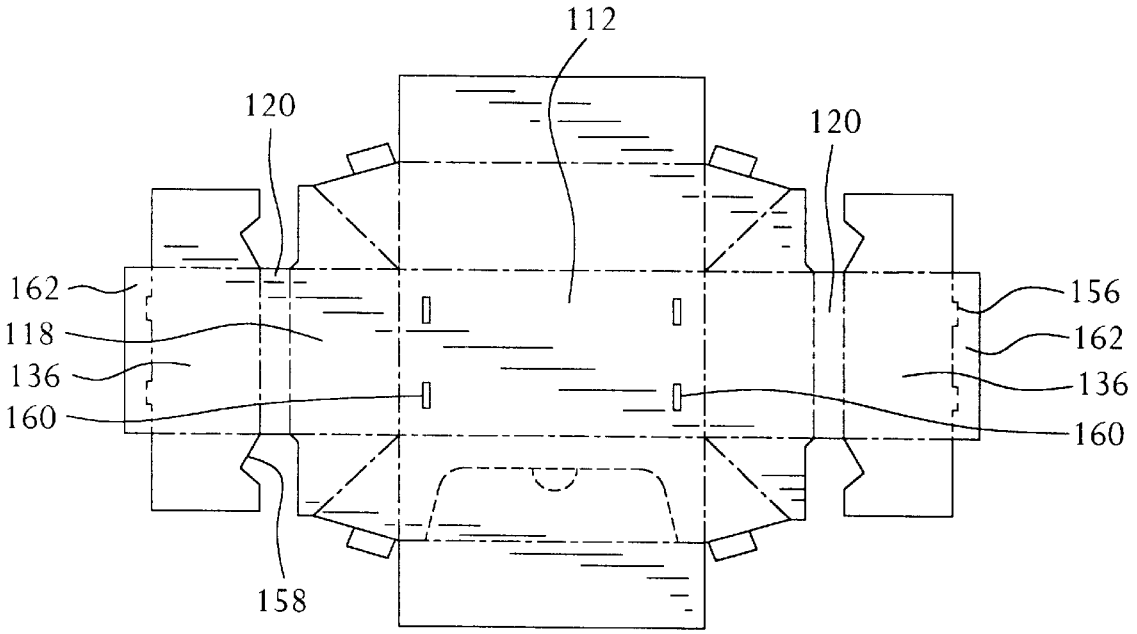
FIG. 8 is top plan view of an integral blank for the container of FIG. 7.

FIG. 7 shows an alternative container configuration 110 according to the invention, in its erected state after folding, gluing and erection from the integral flat blank shown in FIG. 8. This container 110 is similar to container 10 except that it includes a pair of bottom ledges 162, each bottom ledge being foldably connected to a respective one of interior sidewalls 136 at its bottom edge 158 such that when the container is erected the interior sidewalls 136 are oriented vertically in parallel planar relationship with corresponding exterior sidewalls 118. As in the previous embodiment, locking tabs 156 interlock with complementary locking slots 160 located in the bottom wall 112 and in combination with the bottom edges 158 secure the interior sidewalls 136 in position. This embodiment has the advantage of parallel inner sidewalls, but lacks the triangular bracing of the inclined inner sidewalls of FIGS. 1–6 and has slightly less internal volume.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A container comprising;

a plurality of interconnected panels positioned to form a bottom and walls of the container extending between a top and the bottom of the container to define a contained space closed on at least five sides, the walls extending generally upwardly from the bottom when the container is resting thereon, the walls including a front wall, a back wall and opposite side walls, each of the front, back and side walls having a top edge and opposite side edges, and each of the side walls having panels defining an exterior side wall and an interior side wall;

a bellows fold connecting each of the front and back walls with at least one of the exterior side walls;

a pair of interior side walls each having a top edge, a bottom edge, and opposite side edges; and a pair of ledges, each of the ledges hingedly connecting and bridging the top edges of corresponding pairs of the exterior and interior sidewalls;

wherein each bellows fold has a locking tab having a predetermined profile connected thereto;

wherein each interior side wall includes a pair of strengthening flaps hingedly connected to the opposite side edges thereof, each strengthening flap having a top edge; and, wherein when the container is assembled, the locking tab engages against an edge of the strengthening flap to limit lateral deflection of the side walls.

2. A container comprising:

a plurality of interconnected panels forming a bottom of the container and walls extending between a top of the container and said bottom to define a contained space closed on at least five sides, the walls extending generally upwardly from the bottom when the container is resting thereon, the walls including a front wall, a back wall and opposite side walls, each of the front, back and side walls having a top edge, a bottom edge adjacent to the bottom of the container and opposite side edges, and each of the opposite side walls having an exterior side wall panel, an interior side wall panel, and a ledge hingedly connecting and bridging between the interior and exterior side wall panels at the top edge of a corresponding one of the opposite side walls;

a bellows fold connecting each of the front and back walls with at least one of the exterior side walls, each said bellows fold comprising a locking tab having a predetermined profile, connected thereto;

wherein when the container is erected, the locking tab of each said bellows fold engages and abuts at least one of a corresponding one of said interior side wall, said exterior side wall and said ledge to limit lateral deflection of the side walls; and, wherein the bottom edge of each interior side panel includes at least one locking tab which is received by a corresponding slot in the bottom panel.

3. A container comprising:

a plurality of interconnected panels forming a bottom of the container and walls extending between a top of the container and said bottom to define a contained space closed on at least five sides, the walls extending generally upwardly from the bottom when the container is resting thereon, the walls including a front wall, a back wall and opposite side walls, each of the front, back and side walls having a top edge, a bottom edge adjacent to the bottom of the container and opposite side edges, and each of the opposite side walls having an exterior side wall panel, an interior side wall panel, and a ledge hingedly connecting and bridging between the interior and exterior side wall panels at the top edge of a corresponding one of the opposite side walls;

a bellows fold connecting each of the front and back walls with at least one of the exterior side walls, each said bellows fold comprising a locking tab having a predetermined profile, connected thereto;

wherein when the container is erected, the locking tab of each said bellows fold engages and abuts at least one of a corresponding one of said interior side wall, said exterior side wall and said ledge to limit lateral deflection of the side walls; and, wherein at least one of the front and back walls has a removable section.

4. A container comprising:

a plurality of interconnected panels forming a bottom of the container and walls extending between a top of the container and said bottom to define a contained space closed on at least five sides, the walls extending generally upwardly from the bottom when the container is resting thereon, the walls including a front wall, a back wall and opposite side walls, each of the front, back and side walls having a top edge, a bottom edge adjacent to the bottom of the container and opposite side edges, and each of the opposite side walls having an exterior side wall panel, an interior side wall panel, and a ledge hingedly connecting and bridging between the interior and exterior side wall panels at the top edge of a corresponding one of the opposite side walls;

a bellows fold connecting each of the front and back walls with at least one of the exterior side walls, each said bellows fold comprising a locking tab having a predetermined profile, connected thereto;

wherein when the container is erected, the locking tab of each said bellows fold engages and abuts at least one of a corresponding one of said interior side wall, said exterior side wall and said ledge to limit lateral deflection of the side walls; and, further comprising at least one panel closing the top of the container.

5. A blank for a corrugated container comprising:

a bottom panel;

front, back and side panels foldably connected to the bottom panel, each of the front, back and side panels having top and side edges and a bottom edge adjacent to the bottom panel;

wherein each of the side panels comprises an exterior side panel and an interior side panel, foldably connected to a ledge panel at opposite first and second transverse edges of the ledge panel, respectively, the interior and exterior side panels each having top, bottom and side edges;

a bellows fold comprising two triangular panels connected to one another along a diagonal fold, and connected between each of the side edges of the front and back panels and a respective one of the side edges of each of the side panels, one of said triangular panels being attached against one of an adjacent one of said interior side panels and the other of the triangular panels being folded against said one of the triangular panels for holding the container in an erected state;

wherein the exterior side panel, the ledge and the interior side panel fold inwardly to define a space enclosing over the bellows fold; and, further comprising a locking tab disposed in the space enclosing the bellows fold, when the container is in the erected state, the locking tab being attached to one of and engaging at least one other of the bellows fold, the exterior side panel, the interior side panel and the ledge, whereby the locking tab braces the side panels against lateral displacement.

6. The corrugated container blank of claim 5 wherein the locking tab protrudes from and is foldably connected to at least one of the triangular panels of the bellows fold and has a predetermined profile sized to bear between the bellows panel and the exterior side panel, within the space enclosing over the bellows fold.

7. The corrugated container blank of claim 6 further comprising two pairs of the strengthening panels, each of strengthening panels being foldably connected to to a respective one of the side edges of the interior and exterior side panels.

8. The corrugated container of claim 7, wherein the strengthening panels are folded inwardly into the space enclosing the bellows fold and are attached to said one of the interior and exterior side panels, wherein the strengthening panels define a notch, and wherein the locking tab engages in the notch.

9. The corrugated container blank of claim 5, wherein a pair of top flaps are each foldably connected to a respective one of the top edges of the front and back panels.

10. The corrugated container blank of claim 5, wherein the blank consists of an integral sheet of material.

* * * * *